US009816701B2

(12) United States Patent
Chen

(10) Patent No.: US 9,816,701 B2
(45) Date of Patent: Nov. 14, 2017

(54) SAFE GAS DEVICE PROVIDING MORE VISIBLE FLAMES

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 343 days.

(21) Appl. No.: 14/675,817

(22) Filed: Apr. 1, 2015

(65) Prior Publication Data

US 2016/0290654 A1 Oct. 6, 2016

(51) Int. Cl.

| | |
|---|---|
| ***F23D 14/84*** | (2006.01) |
| ***F23D 14/10*** | (2006.01) |
| ***F23D 14/70*** | (2006.01) |
| *F24C 3/00* | (2006.01) |

(52) U.S. Cl.

CPC ..... *F23D 14/84* (2013.01); *F23D 14/10* (2013.01); *F23D 14/70* (2013.01); *F23D 2900/11401* (2013.01); *F24C 3/006* (2013.01)

(58) Field of Classification Search

CPC ..... F24B 1/199

USPC ..... 126/512; 431/351, 350, 352

See application file for complete search history.

(56) References Cited

U.S. PATENT DOCUMENTS

| | | | | |
|---|---|---|---|---|
| 2,446,351 | A * | 8/1948 | Williams | C09C 1/52 422/153 |
| 4,927,356 | A * | 5/1990 | Otsuka | F23D 14/36 431/350 |
| 7,097,448 | B2 | 8/2006 | Chesney | |
| D621,873 | S | 8/2010 | Tsai | |
| 9,163,831 | B2 | 10/2015 | Chen | |
| 9,651,246 | B2 | 5/2017 | Chen | |
| 2008/0160467 | A1 | 7/2008 | Shimazu et al. | |

FOREIGN PATENT DOCUMENTS

| | | |
|---|---|---|
| JP | S5575105 A | 6/1980 |
| TW | 245322 | 4/1995 |
| TW | M461769 U | 9/2013 |

* cited by examiner

*Primary Examiner* — Avinash Savani

(74) *Attorney, Agent, or Firm* — Alan D. Kamrath; Kamrath IP Lawfirm, P.A.

(57) ABSTRACT

A safe gas flame device providing more visible flames includes a burner having an air inlet end and a flame exit. The combustion end is configured to include a horizontal section of a fluid transporting tube. A fluid guiding device connects to the burner and includes at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure.

19 Claims, 9 Drawing Sheets

SAFE GAS DEVICE PROVIDING MORE VISIBLE FLAMES

BACKGROUND OF THE INVENTION

1. Field of the Invention

The present invention relates to a gas device and, particularly, to a gas device that provides more visible flames and that is safe.

2. Description of the Related Art

Heat devices can be classified into two groups —one is electrical and the other is non-electrical. Each group has advantages and disadvantages. A device, which generates heat via combustion of combustible materials, is generally more effective and does not place a heavy burden on an electricity supplying system. Electrical heat devices or non-electrical heat devices such as fireplaces and firepits are both available on the market. Generally, a heat device that generates heat via combustion of combustible materials is used not less often than that via electricity in places in high latitude, and such heat device is popularly used at outdoor places. An electrical heat device normally includes a high-load electrical unit and a heat pipe system. Consequently, electrical heat devices are costly and consume electrical power, and there is a matter of concern about a supply of high-load electrical current. Therefore, electrical heat devices are used more at offices and less at home, and fireplaces are used more to heat homes, in middle and high latitudes, especially countries in high latitude. It is convenient and cheaper to use fireplaces. Typically, combustible materials include cordwood, pellet, propane, or natural gas. Natural gas, when concerning the environmental protection issue, is the cleanest combustible material as it produces the least carbon dioxide per unit of heat energy. On the contrary, wood is a combustible material which is less environmental friendly. In 2012, 70 percent of fireplaces sold in North America use natural gas as a combustible material. In addition, more people are in the market for flame heat devices that not only generate heat, but also are decorative and aesthetic.

Presently, gas flame heat devices, by distributing nozzles or a transparent shield as a fluid guide structure to induce outside airflow due to the "chimney effect", control and change the shape of flames. Commonly, a shield is disposed above a gas flame heat device, and, therefore, the gas flame heat device is half closed. In addition, when a flame is a vortex flame, flames of different shapes are different in an upward axial direction. It is difficult to change a vortex flame in a transverse direction of the flame. Problems usually associated with a gas flame device are that the size of a flame is limited, that gas is easily accumulated, or that the gas flame heat device gets hot. Although the shield can prevent outside airflow to disturb a flame and allow the flame to remain stable, ventilation becomes a problem. Therefore, the gas flame heat device gets hot. Since the shield is provided to shelter the flame, it typically includes a distal end thereof defining a free end and delimiting an opening allowing ventilation. The size of opening of the shield is critical. If the size of opening is big, the shield can not effectually shelter the flame. If the size of opening is small, problems of poor heat and of exhaust gas dissipations can occur despite that the flame can remain stable. Even worse, the flame will extinguish and an incomplete combustion would occur due to a fresh air deficiency. The incomplete combustion will result in soot and poisonous gas. Furthermore, the flame heat device suffers poor heat dissipation if fresh airflow is deficient. Consequently, the longer the flame burns, the hotter the gas flame device becomes.

Without using the shield to guide fluid, changing ways of distributing nozzles is another way to control a flame. Unfortunately, it becomes easy that outside air disturbs the shape of flame, the flame becomes uncontrollable, and the shape of flame changes limitedly.

Recently, a method to control a flame electromagnetically is devised, but such method adopts a complex and costly device and is limited to control a small scale flame only. The device is still in the experimental stages and not on the market. Likewise, if no shield is used, the flame is susceptible to disturbance by outside air.

U.S. Pat. No. 7,097,448 shows a vortex type gas lamp for producing an upwardly directed vortex flame inside a surrounding and confined boundary of a rotating body of air. An interface is located between the body of air which is devoid of gas and a central region of gas which is bounded by the interface during the operation of the gas lamp. Combustion occurs inside the interface. The gas lamp has a central axis and includes a base supplying combustible gas without air at and nearly adjacent to the central axis. A shield includes first and second axially extending sections structurally attached to the base in a fluid sealing relationship. The first and second sections of the shield are substantially identical and transparent to light, and each includes an impermeable wall having an arcuate inner surface and an arcuate outer surface. Each of the first and second sections of the shield has first and second edges extending axially. The gas lamp further includes first and second walls alternately overlapping one another. The first and second walls are adjacent to their edges and spaced from one another and form tangentially directed ports, thereby forming an axially extending mixing chamber open at its side only through the ports. The first and second sections of the shield at the base surround the entry of combustible gas and receive air for combustion only through the ports. Whereby, a flame results from the combustion process is spaced from the inner surfaces, and the peripheral body of air is devoid of gas entering through the ports. In use, fresh air from outside can enter the gas lamp through the ports to keep the flame alive. In reality, the ports can not prevent excess air from entering the chamber to greatly disturb the height and the swirling shape of the flame. Accordingly, the flame from the gas lamp is kept within a scale in order to have a swirling shape. However, the top surface of the base can become too hot to touch as no airflow cools the base. Also, the flame will not have an obvious swirling shape if its scale is small. The flame will not have an obvious swirling shape if the shield is not tall enough. The combustible gas accumulates on the base easily, because it has a greater density than air. If the combustible gas and air become mixed in adequate concentrations and the gas has a higher concentration, a flash fire can occur, and if the combustible gas and air become mixed in adequate concentrations and the gas has a lower concentration, it is difficult to ignite such gas and air mixture. To avoid the risks, a continuous and automatic stopping electronic ignition device is a solution, but incurs high costs. In contrast to a gas lamp that is manually controlled, a gas lamp equipped with a continuous and automatic stopping electronic device is more pricey.

U.S. Design Pat. No. 621,873 shows a fire tornado lamp. A base includes a plurality of ports disposed circumferentially. A shield is transparent to light and hollow and includes a passage. The base and the shield are connected to each other. Each port extends radially with respect to and is in communication with the passage. Each port is configured to induce air into the passage in a direction substantially tangential to a circumference of the passage. Problems are that the ports can not prevent excess air from entering the passage to disturb a flame from the lamp and that the longer the flame burns the hotter the base becomes. A continuous and automatic stopping electronic device may be used to avoid a flash fire risk, but incurs high costs. In addition, air is guided to flow above the bottom of the flame at an angle perpendicular to a flame burning direction.

TW Pat. No. M461769 shows an outdoor use flame heat device. A gas distribution chamber includes the top thereof including a plurality of burner holes and is disposed on a base. A shield is disposed above the flame heat device. An air distribution chamber is disposed between the gas distribution chamber and the shield. A plurality of air holes is distributed around the shield. A glass tube is disposed in the shield and above the plurality of burner holes and the air distribution chamber. It is claimed that the glass tube allows gas and air fully mixed for combustion, that flames can cooperate together to form a net to increase thermal efficiency, and that the flames in the glass tube can extend higher due to the "chimney effect". In reality, wind can blow directly to the burner holes and, therefore, affects the combustion and the shape of the flames. The glass tube makes the ignition timing difficult. If the timing is wrong, flames become turbulent. Only a small amount of outside air flows into the flame heat device, so the longer the flames burn the hotter the flame heat device and the glass tube become. If the ignition timing is too late or if failure of ignition happens, gas will accumulate on the bottom of the flame heat device easily. Therefore, the flame heat device carries risks that the gas has a higher concentration than that of the air and that flash flames occur. To avoid the risks, a continuous and automatic stopping electronic ignition device is a solution, but incurs high costs. In addition, the flame heat device is similar to the above two references in that the bottom thereof is a semi-closed end. A semi-closed area is formed by the plurality of air holes and an end of the glass tube disposed adjacent to burner holes.

The present invention is, therefore, intended to obviate or at least alleviate the problems encountered in the prior art.

SUMMARY OF THE INVENTION

According to the present invention, a safe gas device providing more visible flames includes a burner having an air inlet end and a combustion end at different ends and including the air inlet end thereof configured to include an air inlet head and the combustion end thereof configured to include a horizontal section of a fluid transporting tube respectively. A fluid guiding device connects to the burner and includes at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a gas flame device that provides more visible flames and that is safe.

It is another objective of the present invention to provide a gas flame device that avoids the risks of flash fire and of incomplete combustion.

Other objectives, advantages, and new features of the present invention will become apparent from the following detailed description of the invention when considered in conjunction with the accompanied drawings.

DETAILED DESCRIPTION OF THE INVENTION

Figure 1:
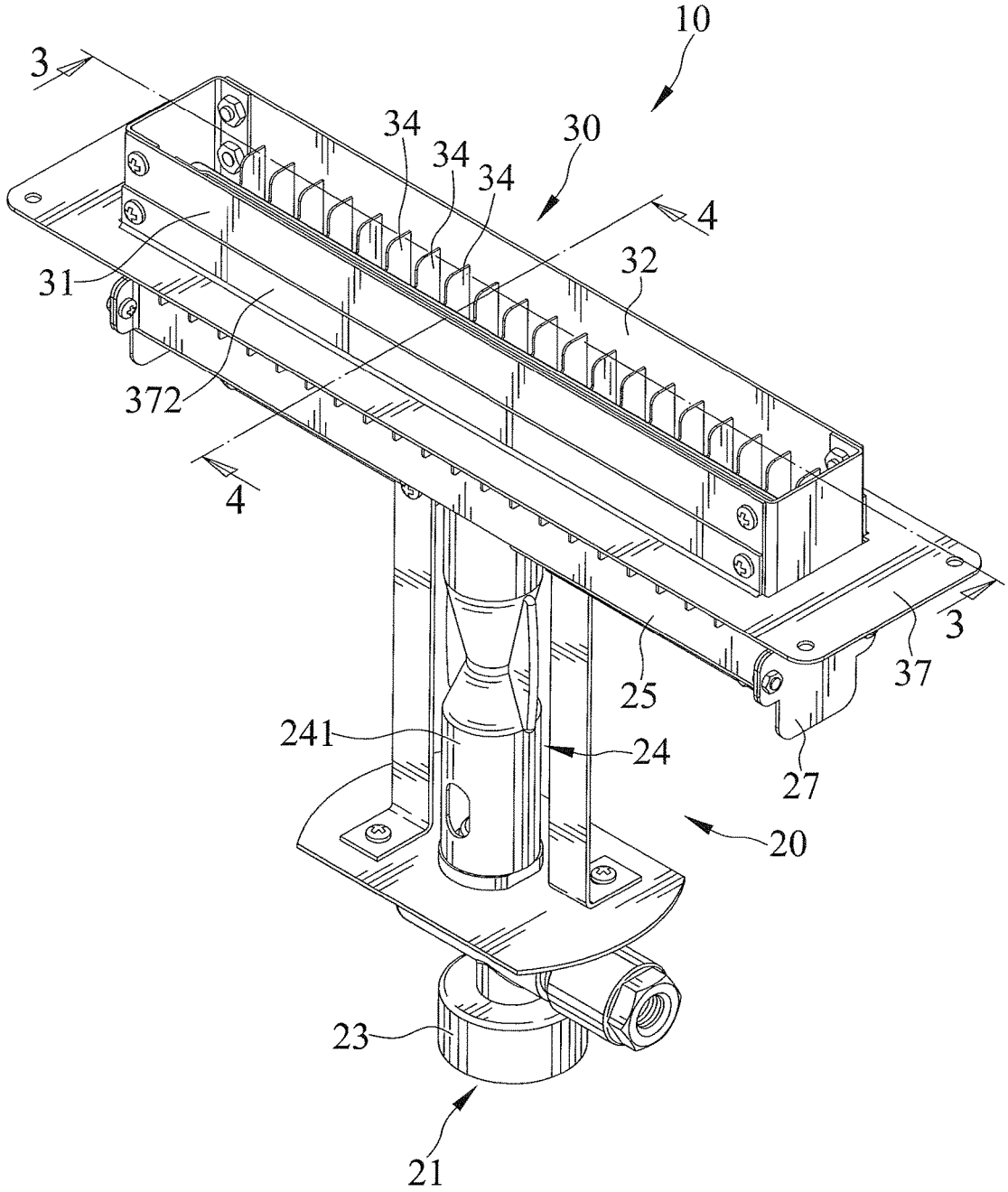
FIG. 1 is a perspective view of a safe gas flame device providing more visible flames in accordance with a first embodiment of the present invention.
Figure 2:
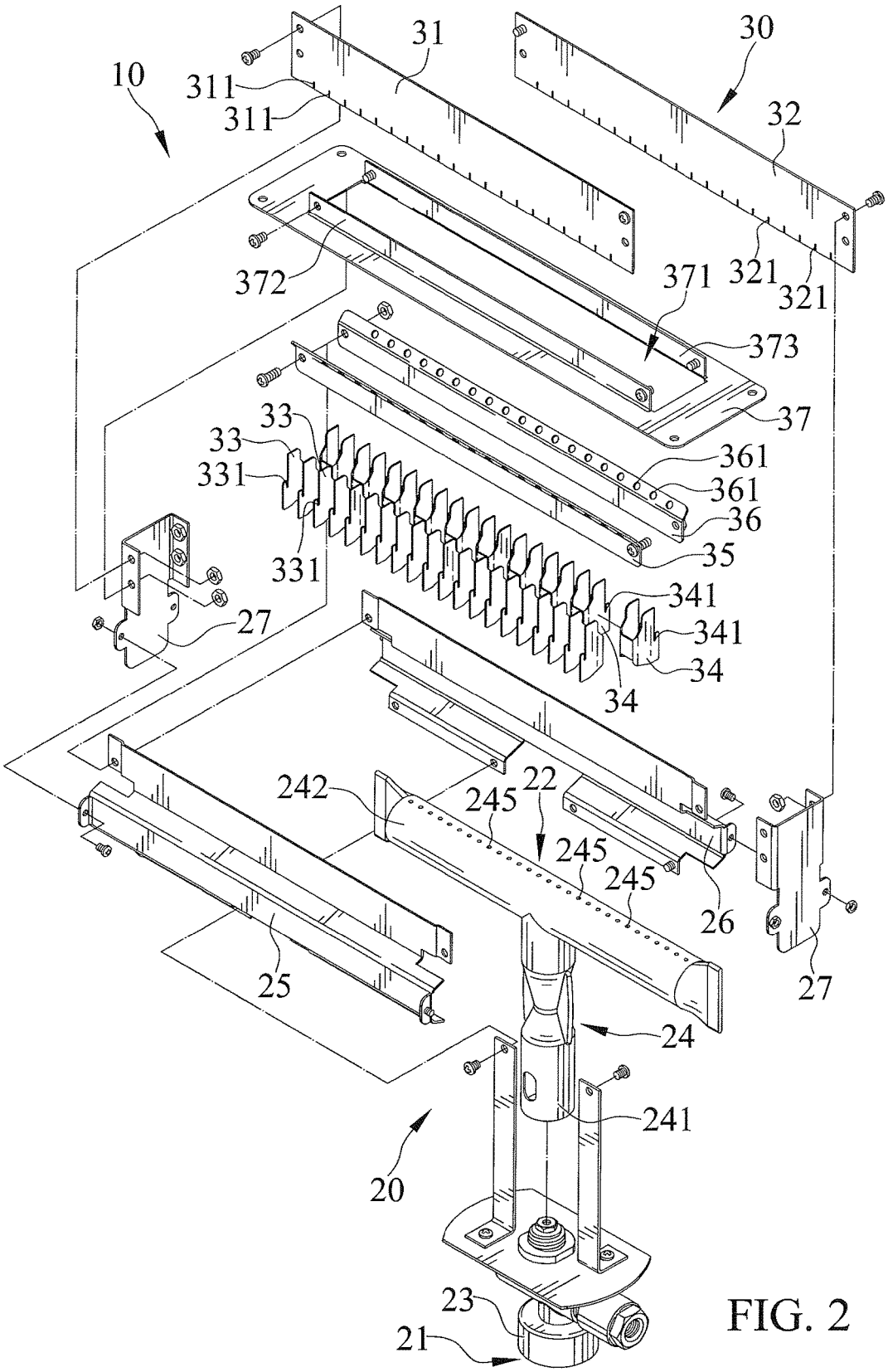
FIG. 2 is an exploded perspective view of the safe gas flame device of the first embodiment of the present invention.
Figure 3:
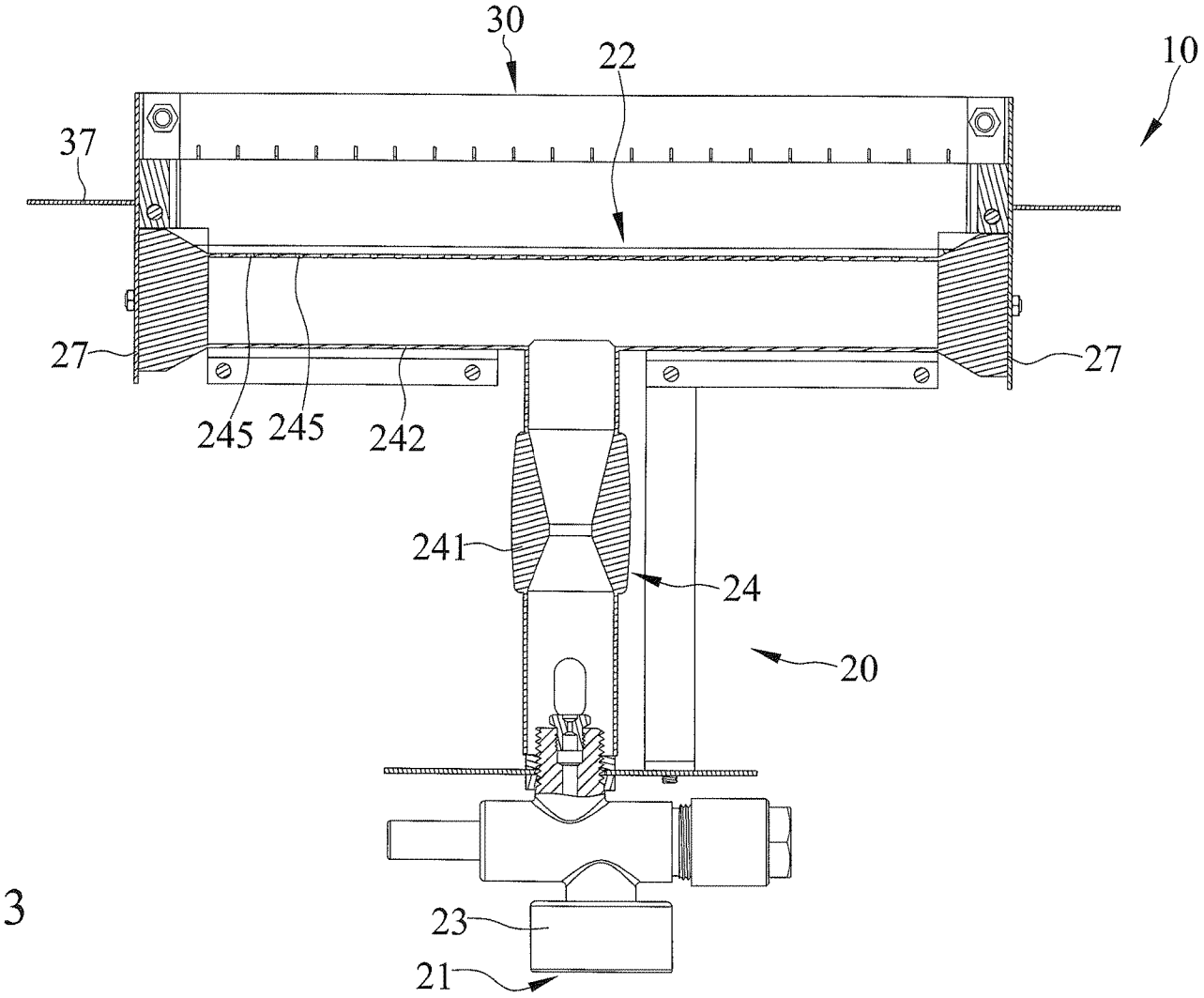
FIG. 3 is a cross-sectional view taken along line 3-3 of FIG. 1.
Figure 4:
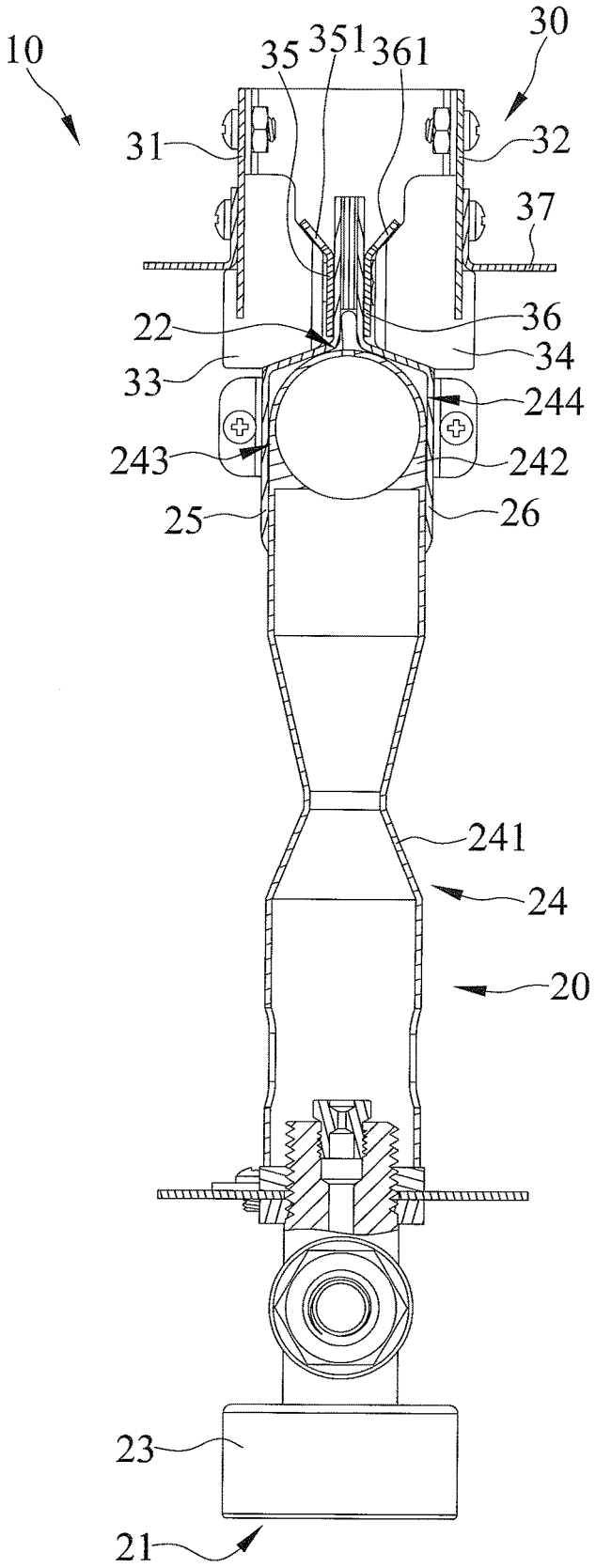
FIG. 4 is a cross-sectional view taken along line 4-4 of FIG. 1.
Figure 5:
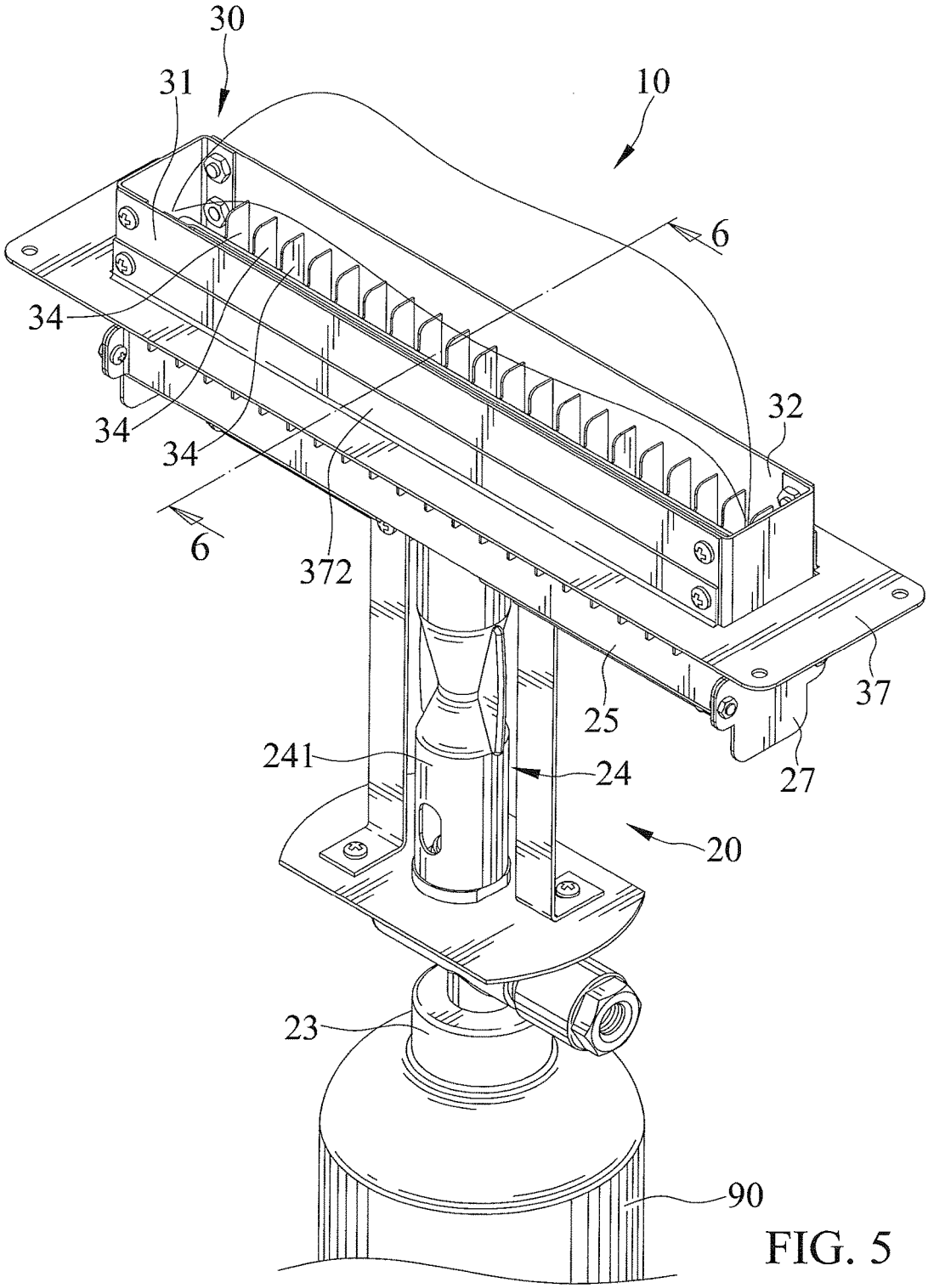
FIG. 5 is a perspective view showing the safe gas flame device of the first embodiment of the present invention in use.
Figure 6:
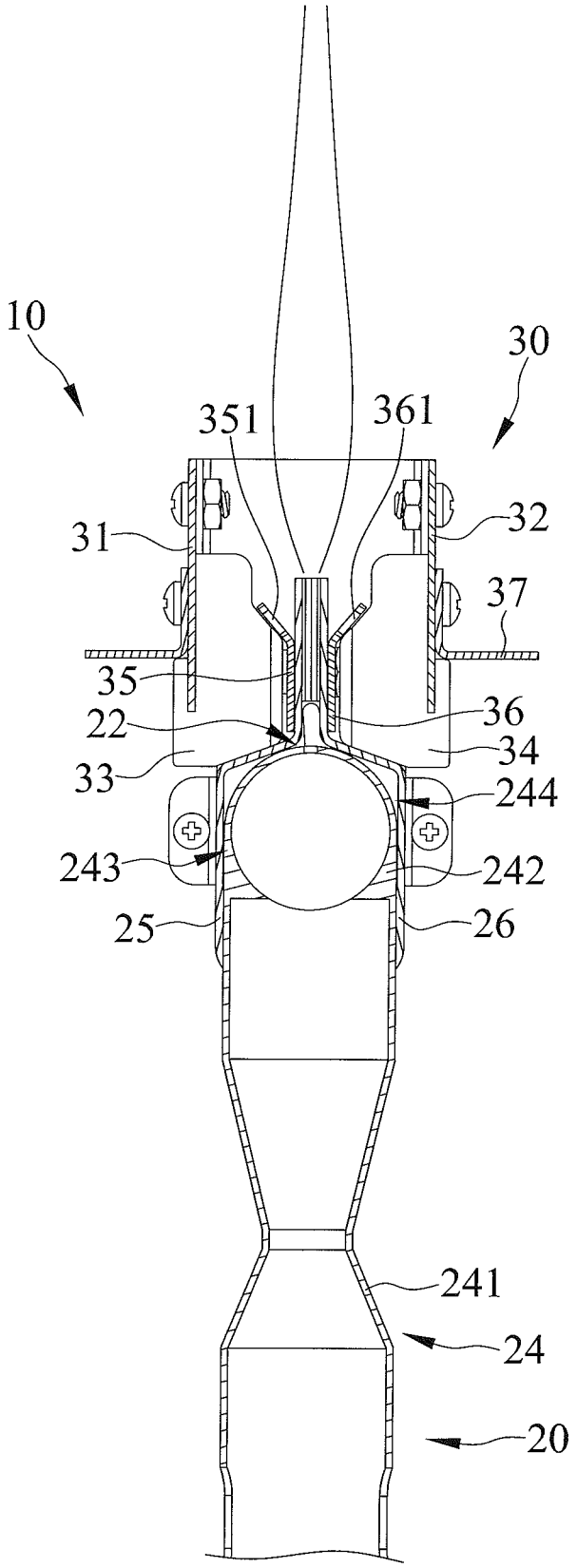
FIG. 6 is a cross-sectional view taken along line 6-6 of FIG. 5.

FIGS. 1 through 6 show a safe gas flame device 10 providing more visible flames in accordance with a first embodiment of the present invention. The safe gas flame device 10 includes a burner 20 and a fluid guiding device 30.

The burner 20 has an air inlet end 21 and a combustion end 22 at different ends. The burner 20 includes the air inlet end 21 thereof configured to include an air inlet head 23 and the combustion end 22 thereof configured to include a horizontal section 242 of a fluid transporting tube 24 respectively.

In use of the safe gas flame device 10, a gas reservoir 90 is connected to and in fluid communication with the air inlet head 23. The gas reservoir 90 can supply gas to the safe gas flame device 10.

Fluids are transported in the fluid transporting tube 24. The fluid transporting tube 24 includes a section 241 extending therefrom and the horizontal section thereof in fluid communication with the section. The fluid transporting tube 24 includes the section thereof extending vertically from the middle of the horizontal section 242 thereof. Therefore, the fluid transporting tube 24 is in a form of a letter T. The fluid transporting tube 24 includes the section thereof having an end connecting to and in communication with the air inlet head 23. Moreover, the fluid transporting tube 24 includes at least one air hole extending laterally therethrough. Therefore, the air hole aids ventilation. Moreover, the fluid transporting tube 24 includes the section 241 thereof configured to form a convergent-divergent duct. The convergent-divergent duct includes a convergent end adjacent to the air inlet head 23. Therefore, fluid flowing through the convergent-divergent duct is accelerated.

The horizontal section 242 of the fluid transporting tube 24 defines two opposite lateral sides in which one is a first lateral side 243 and the other is a second lateral side 244. The first and second lateral sides 243 and 244 extend longitudinally along a length of the horizontal section 242 of the fluid transporting tube 24. The horizontal section 242 of the fluid transporting tube 24 includes the length thereof extending axially.

The horizontal section 242 of the fluid transporting tube 24 includes a plurality of fluid exit apertures 245 extending therethrough. The plurality of fluid exit apertures 245 is disposed side by side along the length of the horizontal section 242 of the fluid transporting tube 24.

At least one first and at least one second fluid gathering structures 25 and 26 are disposed on opposite sides of the fluid transporting tube 24 and delimit a catchment area in between at the combustion end 22. The at least one first and at least one second fluid gathering structures 25 and 26 extend along the length of the horizontal section 242 of the fluid transporting tube 24.

The fluid guiding device 30 connects to the burner 20. The fluid guiding device 30 includes at least one first and at least one second supporting structures 31 and 32, a plurality of first fluid guiding members 33, and a plurality of second fluid guiding members 34.

The at least one first and at least one second supporting structures 31 and 32 are disposed on opposite sides of the fluid transporting tube 24. The at least one first and at least one second supporting structures 31 and 32 face oppositely. The at least one first and at least one second supporting structures 31 and 32 are identical in shape. Two connecting stands 27 interconnect and extend between the at least one first and at least one second supporting structures 31 and 32. The two connecting stands 27 are disposed oppositely.

Fluids are guided by the pluralities of first and second fluid guiding members 33 and 34. In addition, the pluralities of first and second fluid guiding members 33 and 34 are disposed symmetrically with respect to the plurality of fluid exit apertures 245. The plurality of fluid exit apertures 245 is between the pluralities of first and second fluid guiding members 33 and 34.

The plurality of first fluid guiding members 33 connects and extends transversely to the at least one first supporting structure 31 and is arranged side by side along a length of the at least one first supporting structure 31. The plurality of first fluid guiding members 33 is also disposed side by side along the length of the horizontal section 242 of the fluid transporting tube 24. The plurality of first fluid guiding members 33 releasably and insertably connects to the at least one first supporting structure 31. The at least one first supporting structures includes a plurality of first slots 311. Each of the plurality of first fluid guiding members 33 has at least one connecting area tightly fitting in one of the plurality of first slots 311. The plurality of first slots 311 recesses from a bottom side of the at least one first supporting structure31. The at least one connecting area of each of the plurality of first fluid guiding members 33 recesses between edges of each of the plurality of first fluid guiding members 33. Therefore, there is a recess 331 associated with the at least one connecting area of each of the plurality of first fluid guiding members 33.

The plurality of second fluid guiding members 34 connects and extends transversely to the at least one second supporting structure 32 and is arranged side by side along a length of the at least one second supporting structure 32. The plurality of second fluid guiding members 34 is also disposed side by side along the length of the horizontal section 242 of the fluid transporting tube 24. The plurality of second fluid guiding members 34 releasably and insertably connects to the at least one second supporting structure 32. The at least one second supporting structure includes a plurality of second slots 321. Each of the plurality of second fluid guiding members 34 has at least one connecting area tightly fitting in one of the plurality of second slots 321. The plurality of second slots 321 recesses from a bottom side of the at least one second supporting structure 32. The at least one connecting area of each of the plurality of second fluid guiding members 34 recesses between edges of each of the plurality of second fluid guiding members 34. Therefore, there is a recess 341 associated with the at least one connecting area of each of the plurality of second fluid guiding members 34.

Furthermore, fluid is guided to flow uniformly by the pluralities of first and second fluid guiding members 33 and 34. The pluralities of first and second fluid guiding members 33 and 34 are identical in overall shape and size. Therefore, it is also cost-effective to make the pluralities of first and second fluid guiding members 33 and 34. Each of the pluralities of first and second fluid guiding members 33 and 34 has a shape including two first extensions facing oppositely and separated by a gap and a second extension extending between and interconnecting the two first extensions. The two first extensions of each of the plurality of first fluid guiding members 33 extend transversely to the at least one first supporting structure 31. The two first extensions of each of the plurality of second fluid guiding members 34 extend transversely to the at least one second supporting structure 32. In addition, the plurality of first fluid guiding members 33 includes top edges thereof in the same level. The plurality of second fluid guiding members 34 includes top edges thereof in the same level. The pluralities of first and second fluid guiding members 33 and 34 include top edges thereof in the same level.

The at least one first and at least one second supporting structures 31 and 32 are respectively disposed above the at least one first and at least one second fluid gathering structures 25 and 26. The at least one first and at least one second fluid gathering structures 25 and 26 each includes one end separated by a first space and the other end separated by a second space. The catchment area is delimited in the first space. The horizontal section 242 of the fluid transporting tube 24 is disposed within the second space. The first space is smaller than the second space in width.

At least one third and at least one fourth fluid guiding members 35 and 36 are disposed on opposite sides of the catchment area. Fluids are guided by the at least one third and at least one fourth fluid guiding members 35 and 36. The at least one third fluid guiding member 35 is connected to the at least one first fluid gathering structure 25. The at least one fourth fluid guiding member 36 is connected to the at least one second fluid gathering structure 26. The at least one third and at least one fourth fluid guiding members 35 and 36 include free ends extending divergently from one another. Each of the at least one third and at least one fourth fluid guiding members 35 and 36 includes the free end thereof including at least one fluid guiding hole 351 and 361 extending therethrough, respectively. The at least one third fluid guiding member 35 includes the free end thereof including the at least one first fluid guiding hole 351 extending therethrough. The at least one fourth guiding member 36 includes the free end thereof including the at least one second fluid guiding hole 361 extending therethrough.

A surrounding frame 37 can be used to connect to a supporting structure to allow the supporting structure to stably bear a combination of the burner 20 and the fluid guiding device 30. The surrounding frame 37 connects to the at least one first and at least one second supporting structures 31 and 32 and configured to include a through hole 371. The combination of the burner 20 and the fluid guiding device 30 includes a structure thereof including a part disposed outside the though hole and a part disposed inside the through hole. The surrounding frame 37 includes a first wall 372, and the first wall 372 and the at least one first supporting structure 31 are connected together. The surrounding frame 37 includes a second wall 373, and the second wall 373 and the at least one second supporting structure 32 are connected together. The surrounding frame 37 and the at least one first and at least one second supporting structures 31 and 32 are releasably interconnected by a plurality of fastening units. Each of the plurality of fastening units includes a fastener with outer threads and a nut with inner threads engagable with the outer threads of the fastener. Each of the plurality of fastening units includes the fastener thereof inserting through a hole recessing in the first wall 372 of the surrounding frame 37 or a hole recessing in the second wall 373 of the surrounding frame 37, and a hole recessing in the at least one first supporting structure 31 or a hole recessing in the at least one second supporting structure 32, and in thread engagement with the nut thereof.

The safe gas flame device 10 provides an upward flame. Therefore, the pluralities of first and second fluid guiding members 33 and 34 and the at least one first and at least one second supporting structures 31 and 32 are disposed above the at least one first and second fluid gathering structures 25 and 26 and the combustion end 22 of the burner 20.

Figure 7:
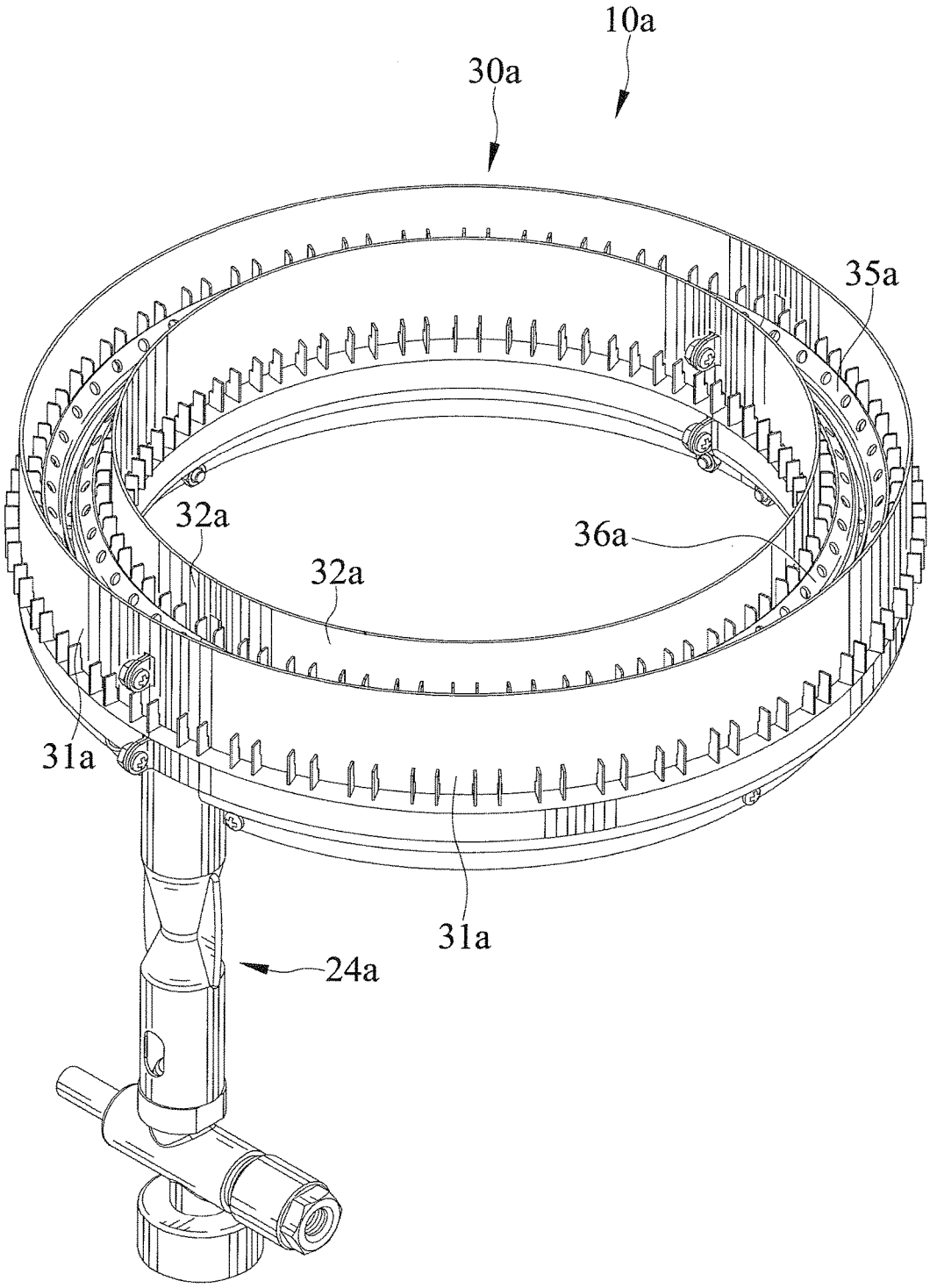
FIG. 7 is a perspective view of a safe gas flame device providing more visible flames in accordance with a second embodiment of the present invention.
Figure 8:
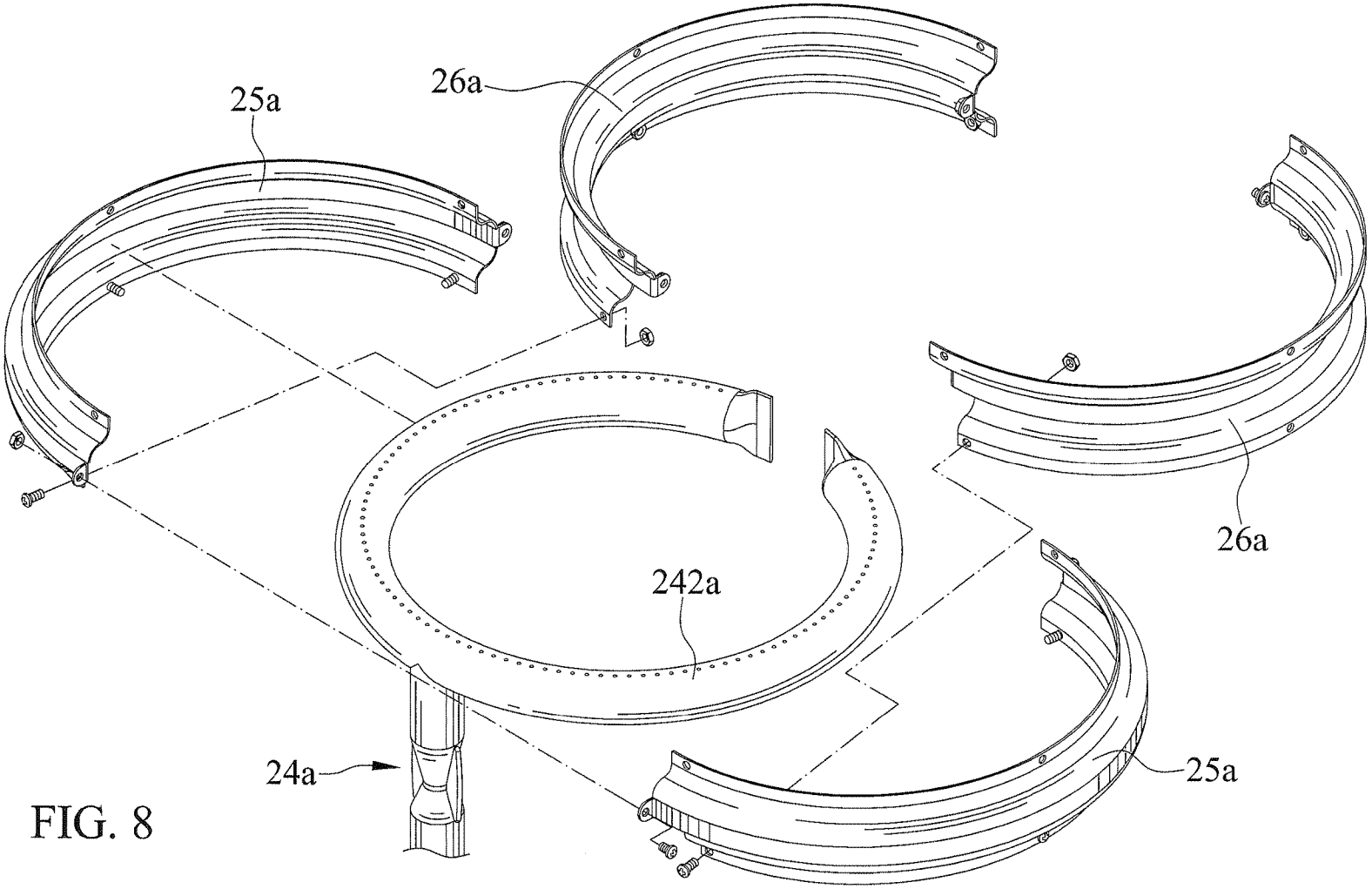
FIG. 8 is a partial, exploded perspective of the safe gas flame device of the second embodiment of the present invention.
Figure 9:
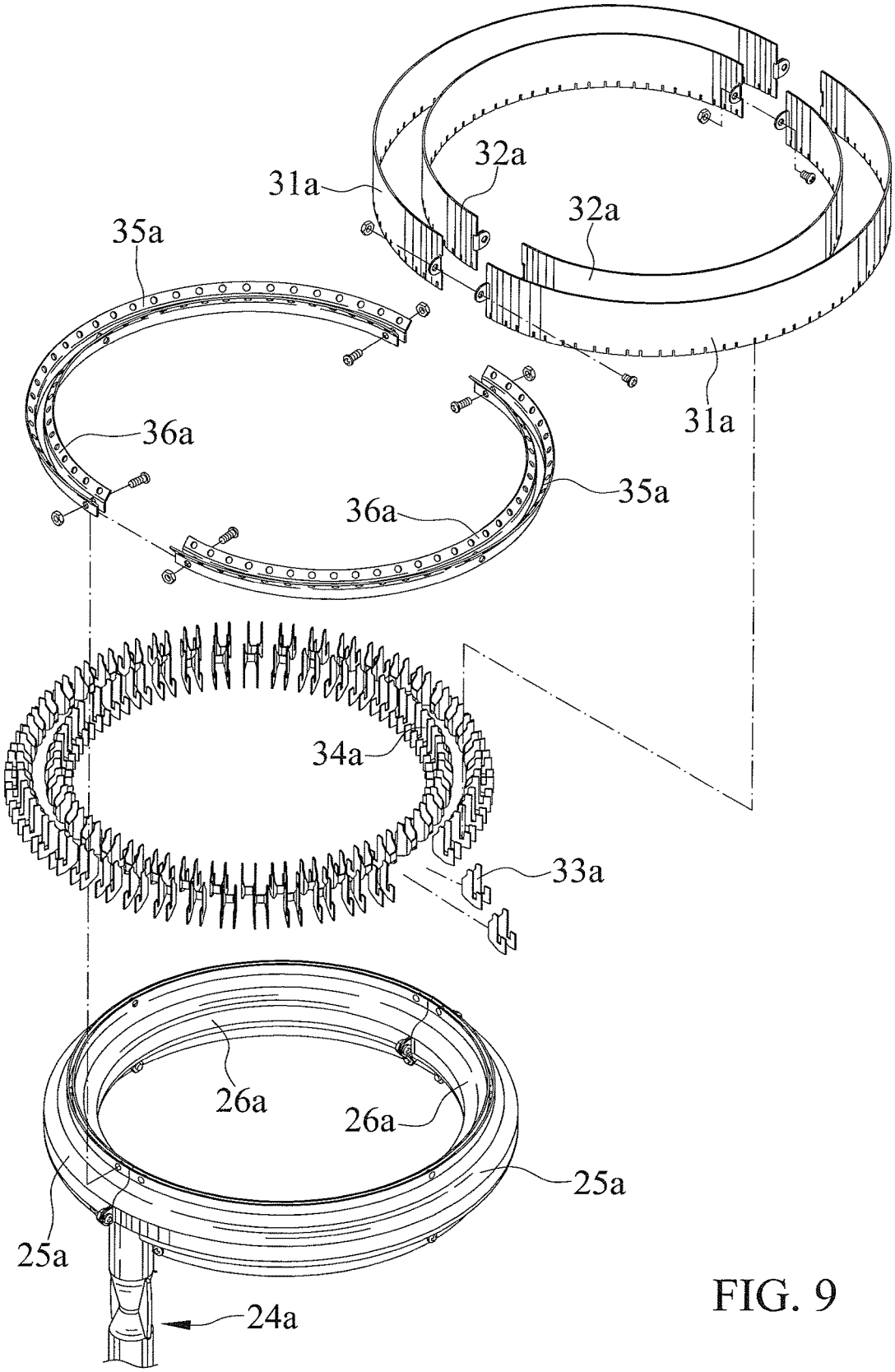
FIG. 9 is another partial, exploded perspective of the safe gas flame device of the second embodiment of the present invention.

FIGS. 6 through 9 show a safe gas flame device 10*a* providing more visible flames in accordance with a second embodiment of the present invention, and same numbers are used to correlate similar components of the first embodiment, but bearing a letter a. The safe gas flame device 10*a* is similar to that of the first embodiment except that a fluid transporting tube 24*a* includes a horizontal section 242*a* thereof extending annularly in length. Moreover, the safe gas flame device 10*a* includes two first and two second fluid gathering structures 25*a* and 26*a* extending along the length of the horizontal section 242*a* of the fluid transporting tube 24*a*. The two first fluid gathering structures 25*a* connect together and form a first annular structure and the two second gathering structures 26*a* connect together and form a second annular structure respectively. The horizontal section 242 of the fluid transporting tube 24*a* and the first and second annular structures are disposed concentrically. The first annular structure is disposed outside the horizontal section 242*a* of the fluid transporting tube 24*a*. The second annular structure is disposed inside the horizontal section 242*a* of the fluid transporting tube 24*a*. Moreover, the safe gas flame device 10*a* includes a fluid guiding device 30*a* including two first and two second supporting structures 31*a* and 32*a* extending along the annular length of the horizontal section 242*a* of the fluid transporting tube 24*a*. The two first supporting structures 31*a* connect together and form a third annular structure and two second supporting structures 32*a* connect together and form a fourth annular structure respectively. The horizontal section 242 of the fluid transporting tube 24*a* and the third and fourth annular structures are disposed concentrically. The third annular structure is disposed outside the horizontal section 242*a* of the fluid transporting tube 24*a*. The fourth annular structure is disposed inside the horizontal section 242*a* of the fluid transporting tube 24*a*. Differences also include that a plurality of first fluid guiding members 33*a* is disposed side by side along an annular length of a combination of the two first supporting structures 31*a* and a plurality of second fluid guiding members 34*a* is disposed side by side along an annular length of the two second supporting structures 32*a* respectively, as well as two third and two fourth fluid guiding members 35*a* and 36*a* extending along the annular length of the horizontal section 242*a* of the fluid transporting tube 24*a*. Despite that the pluralities of first and second fluid guiding members 33*a* and 34*a* are arranged annularly, the pluralities of first and second fluid guiding members 33*a* and 34*a* are of the same shape as the pluralities of first and second fluid guiding members 33 and 34.

In view of the forgoing, the safe gas flame devices 10 and 10*a* are adapted to provide more visible flames. Furthermore, the safe gas flame devices 10 and 10*a* include the fluid guiding devices 30 and 30*a* thereof including fluid guiding members 33, 33*a*, 34, and 34*a* specially arranged to avoid the risks set forth.

The foregoing is merely illustrative of the principles of this invention, and various modifications can be made by those skilled in the art without departing from the scope and spirit of the invention.

What is claimed is:

1. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively; and a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure;

wherein the plurality of first fluid guiding members releasably and insertably connects to the at least one first supporting structure, with the at least one first supporting structure including a plurality of first slots, and with each of the plurality of first fluid guiding members having at least one connecting area tightly fitting in one of the plurality of first slots, and wherein the plurality of second fluid guiding members releasably and insertably connects to the at least one second supporting structure, with the at least one second supporting structure including a plurality of second slots, and with each of the plurality of second fluid guiding members having at least one connecting area tightly fitting in one of the plurality of second slots.

2. The safe gas flame device providing more visible flames as claimed in claim 1, wherein the plurality of first slots recesses from a bottom side of the at least one first supporting structure and the plurality of second slots recesses from a bottom side of the at least one second supporting structure respectively, and wherein the pluralities of first and second fluid guiding members include top edges thereof in a same level.

3. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively;

a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure; and at least one first and at least one second fluid gathering structures disposed on opposite sides of the fluid transporting tube and delimit a catchment area in between at the combustion end, and wherein the at least one first and at least one second supporting structures are respectively disposed above the at least one first and at least one second fluid gathering structures.

4. The safe gas flame device providing more visible flames as claimed in claim 3, wherein the at least one first and at least one second fluid gathering structures include ends separated by a first space and other ends separated by a second space, wherein the catchment area is delimited in the first space, wherein the horizontal section of the fluid transporting tube is disposed within the second space, and wherein the first space is smaller than the second space in width.

5. The safe gas flame device providing more visible flames as claimed in claim 3 further comprising at least one third and at least one fourth fluid guiding members disposed on opposite sides of the catchment area.

6. The safe gas flame device providing more visible flames as claimed in claim 5, wherein the at least one third and at least one fourth fluid guiding members include free ends extending divergently from one another.

7. The safe gas flame device providing more visible flames as claimed in claim 6, wherein each of the at least one third and at least one fourth fluid guiding members includes the free end thereof including at least one fluid guiding hole extending therethrough.

8. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively; and a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure;

wherein the horizontal section of the fluid transporting tube has a length, wherein the plurality of first fluid guiding members is disposed side by side along the length of the horizontal section of the fluid transporting tube, and wherein the plurality of second fluid guiding members is disposed side by side along the length of the horizontal section of the fluid transporting tube.

9. The safe gas flame device providing more visible flames as claimed in claim 8, wherein the horizontal section of the fluid transporting tube includes a plurality of fluid exit apertures extending therethrough, wherein the plurality of fluid exit apertures is disposed side by side along the length of the horizontal section of the fluid transporting tube, and wherein the plurality of fluid exit apertures is in between the pluralities of first and second fluid guiding members.

10. The safe gas flame device providing more visible flames as claimed in claim 8, wherein the horizontal section of the fluid transporting tube includes the length thereof extending axially.

11. The safe gas flame device providing more visible flames as claimed in claim 8, wherein the horizontal section of the fluid transporting tube includes the length thereof extending annularly.

12. The safe gas flame device providing more visible flames as claimed in claim 10, wherein the at least one first and at least one second fluid gathering structures extend along the length of the horizontal section of the fluid transporting tube.

13. The safe gas flame device providing more visible flames as claimed in claim 11 further comprising two first and two second fluid gathering structures extending along the length of the horizontal section of the fluid transporting tube, wherein the two first fluid gathering structures connect together and form a first annular structure and the two second gathering structures connect together and form a second annular structure respectively, wherein the horizontal section of the fluid transporting tube and the first and second annular structures are disposed concentrically, with the at least one first supporting structure and the at least one second supporting structure comprising two first and two second supporting structures extending along the length of the horizontal section of the fluid transporting tube, wherein the two first supporting structures connect together and form a third annular structure and the two second supporting structures connect together and form a fourth annular structure respectively, and wherein the horizontal section of the fluid transporting tube and the third and fourth annular structures are disposed concentrically.

14. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively;

a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure; and two connecting stands interconnecting and extending between the at least one first and the at least one second supporting structures, and wherein the two connecting stands are disposed oppositely.

15. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively; and a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure;

wherein each of the pluralities of first and second fluid guiding members has a shape including two first extensions facing oppositely and separated by a gap and a second extension extending between and interconnecting the two first extensions, wherein the two first extensions of each of the plurality of first guiding members extend transversely to the at least one first supporting structure, and wherein the two first extensions of each of the plurality of second fluid guiding members extend transversely to the at least one second supporting structure.

16. The safe gas flame device providing more visible flames as claimed in claim 15, wherein the pluralities of first and second fluid guiding members are identical in overall shape and size.

17. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively;

a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure; and a surrounding frame connecting to the at least one first and the at least one second supporting structures and configured to include a through hole, wherein a combination of the burner and the fluid guiding device includes a structure thereof including a part disposed outside the though hole and a part disposed inside the through hole.

18. A safe gas flame device providing more visible flames, comprising:

a burner having an air inlet end and a combustion end at different ends and including the air inlet end thereof configured to include an air inlet head and the combustion end thereof configured to include a horizontal section of a fluid transporting tube respectively; and a fluid guiding device connecting to the burner and including at least one first and at least one second supporting structures disposed on opposite sides of the fluid transporting tube, a plurality of first fluid guiding members connecting and extending transversely to the at least one first supporting structure and arranged side by side along a length of the at least one first supporting structure, and a plurality of second fluid guiding members connecting and extending transversely to the at least one second supporting structure and arranged side by side along a length of the at least one second supporting structure;

wherein the fluid transporting tube includes a section extending therefrom and the horizontal section thereof in fluid communication with the section, wherein the fluid transporting tube includes the section thereof extending vertically from the middle of the horizontal section thereof, and wherein the fluid transporting tube includes the section thereof having an end connecting to and in communication with the air inlet head.

19. The safe gas flame device providing more visible flames as claimed in claim 18, wherein the fluid transporting tube includes the section thereof configured to form a convergent-divergent duct, and wherein the convergent-divergent duct includes a convergent end adjacent to the air inlet head.

* * * * *